United States Patent [19]

Ping-chuan

[11] Patent Number: 4,846,743

[45] Date of Patent: Jul. 11, 1989

[54] WATER SKIING BUOYANT SHOES

[76] Inventor: Chang Ping-chuan, Lee, Bair-Ho Jenn, Tainan Hsien, Taiwan

[21] Appl. No.: 118,230

[22] Filed: Nov. 6, 1987

[51] Int. Cl.[4] ..... A63C 15/03

[52] U.S. Cl. ..... 441/77; 114/361; 440/17; 441/76

[58] Field of Search ..... 114/126, 361; 440/17, 440/18, 19, 20, 21; 441/73, 76, 77, 78

[56] References Cited

U.S. PATENT DOCUMENTS

| | | | |
|---|---|---|---|
| 245,418 | 8/1881 | Urch | 114/39.1 |
| 1,344,225 | 6/1920 | Halbow | 441/77 |
| 2,752,874 | 7/1956 | Held | 114/126 |
| 3,042,945 | 7/1962 | Saeman | 441/135 |

FOREIGN PATENT DOCUMENTS

| | | | |
|---|---|---|---|
| 72820 | 6/1894 | Fed. Rep. of Germany | 440/21 |
| 455052 | 1/1928 | Fed. Rep. of Germany | 441/77 |
| 2625525 | 12/1977 | Fed. Rep. of Germany | 441/73 |
| 433935 | 4/1949 | Italy | 441/77 |
| 671327 | 10/1964 | Italy | 441/77 |
| 243927 | of 0000 | United Kingdom | 441/77 |

*Primary Examiner*—Sherman D. Basinger
*Assistant Examiner*—Thomas J. Brahan
*Attorney, Agent, or Firm*—Asian Pacific International Patent and Trademark Office

[57] ABSTRACT

The invention is to provide a kind of skiing shoes especially referring to a kind of water skiing buoyant shoes. The distinctive features are on a pair of skiing shoe base members buoyant on water surface, we can walk freely and it becomes an additional updated, unique, novel and excitative recreation of water activities. Besides, the invention can be converted to have the function of a sailboat for the pleasure of sailing. The advantages of the invention are high safety, easy to be assemblied, convenient to walk on water surface and buoyancy to be free from sinking. We can enjoy not only the pleasure of water activity but the sceneries around as well as underwater.

6 Claims, 6 Drawing Sheets

WATER SKIING BUOYANT SHOES

BACKGROUND OF THE INVENTION

This invention relates to a manual propulsion mechanism usable on water for transportation and/or personal enjoyment. The mechanism comprises two laterally-spaced buoyant pontoons having socket structures in their upper faces adapted to receive the feet of a person standing upright on the pontoons. Paddle structures are swingably attached to undersurface areas of the pontoons to produce the desired propulsion effect as the person slides his feet forward in a fashion resembling that used in cross-country skiing.

Somewhat similar mechanisms have been proposed in U.S. Pat. Nos. 3,835,494 to Dougherty, 3,777,324 to Jenkins, 3,936,897 to Schaumann, 2,482,074 to Stephens, and 4,459,118 to Schaumann.

SUMMARY OF THE INVENTION

The invention contemplates a ski-type water propulsion mechanism wherein retractable propulsion paddles on the undersides of buoyant pontoons are connected by flexible cables to hand-operated control sticks mounted at waist level above the pontoons. The control stick motions are cable-coordinated with retractive motions of the paddles such that the person can alternately stride forward with one foot while the other foot is anchored against rearward slippage, and then stride forward with the other foot while the first foot is anchored. The paddles act as reactive anchorage devices to prevent the associated pontoons from slipping rearwardly during the forward striding motions.

THE DRAWINGS

Figure 5:
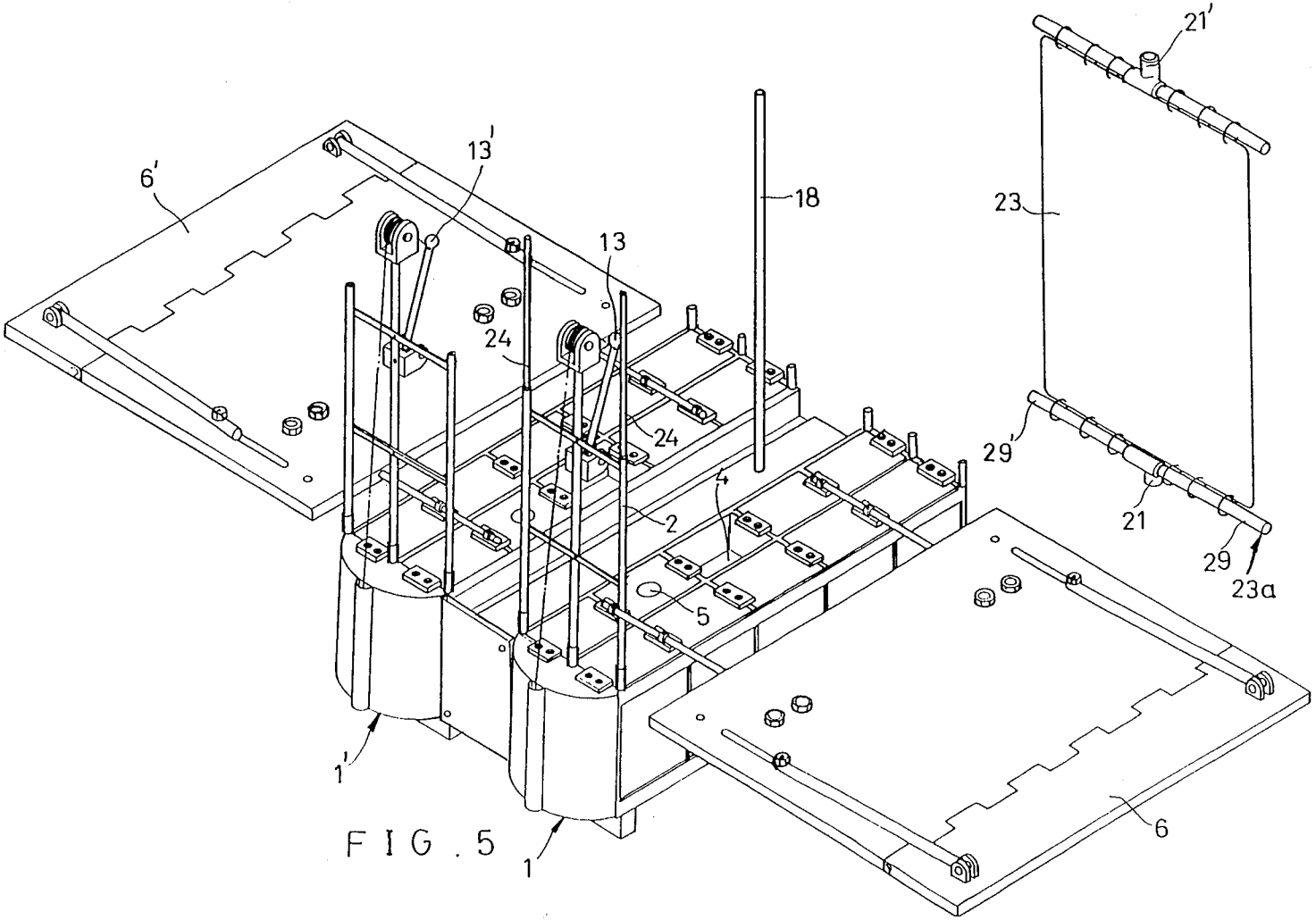
FIG. 5 is a view similar to FIG. 4, with some parts connected.
Figure 6:
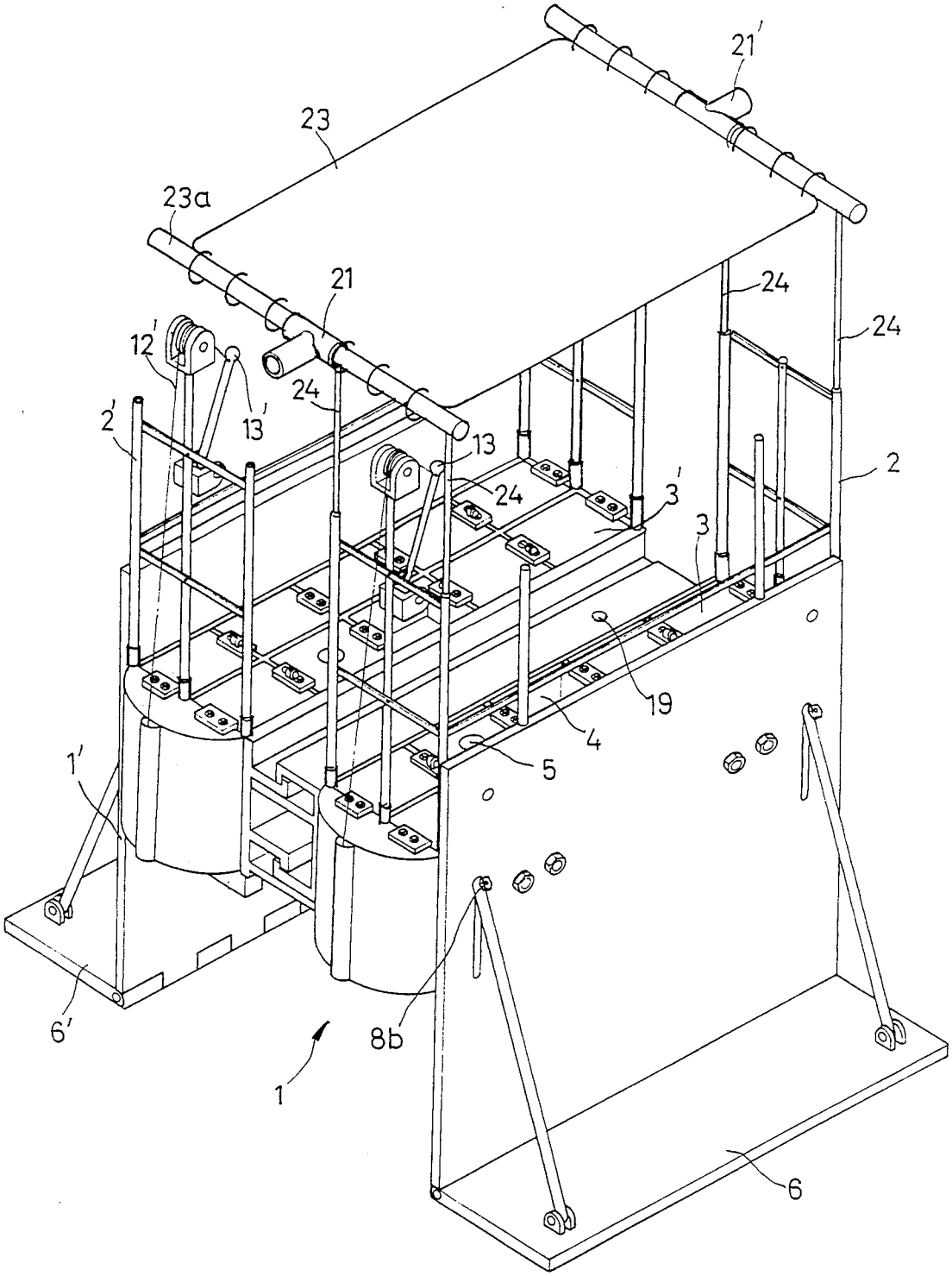
Figure 7:
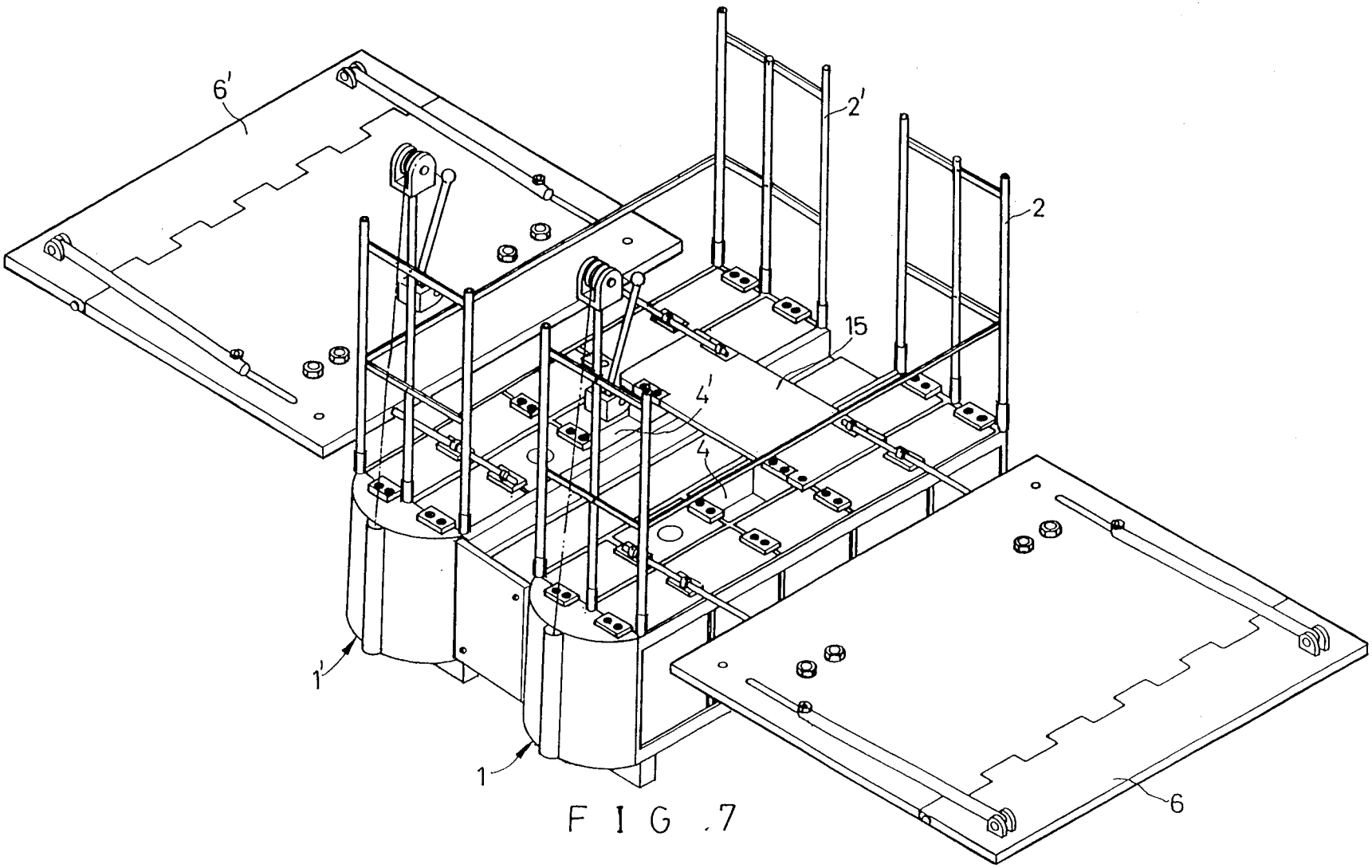

FIG. 6 and 7 view similar to FIG. 5, with some parts in different conditions of adjustment.

DESCRIPTION OF A PREFERRED EMBODIMENT OF THE INVENTION

Figure 4:
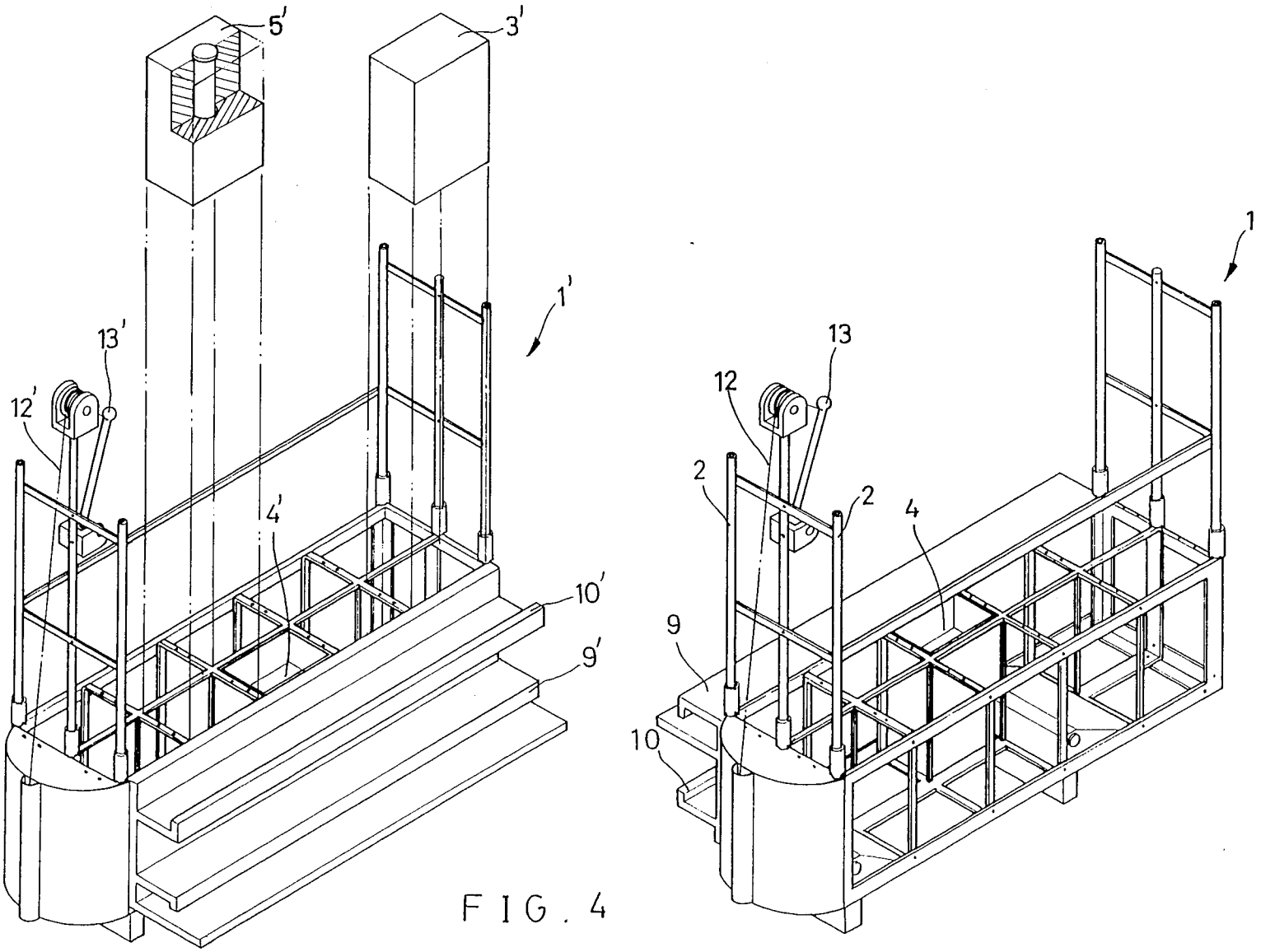
FIG. 4 is a perspective view of the FIG. 1 apparatus, with parts in exploded (detached) positions.

The invention contemplates two laterally-spaced pontoon structures slidably coupled together for relative slidable motion parallel to a directional axis midway between the pontoon structures. FIG. 4 shows the two pontoon structures in exploded partially-assembled condition. Similar parts on the respective pontoons are designated by similar reference numerals with the addition of primes where applicable.

Figure 3:
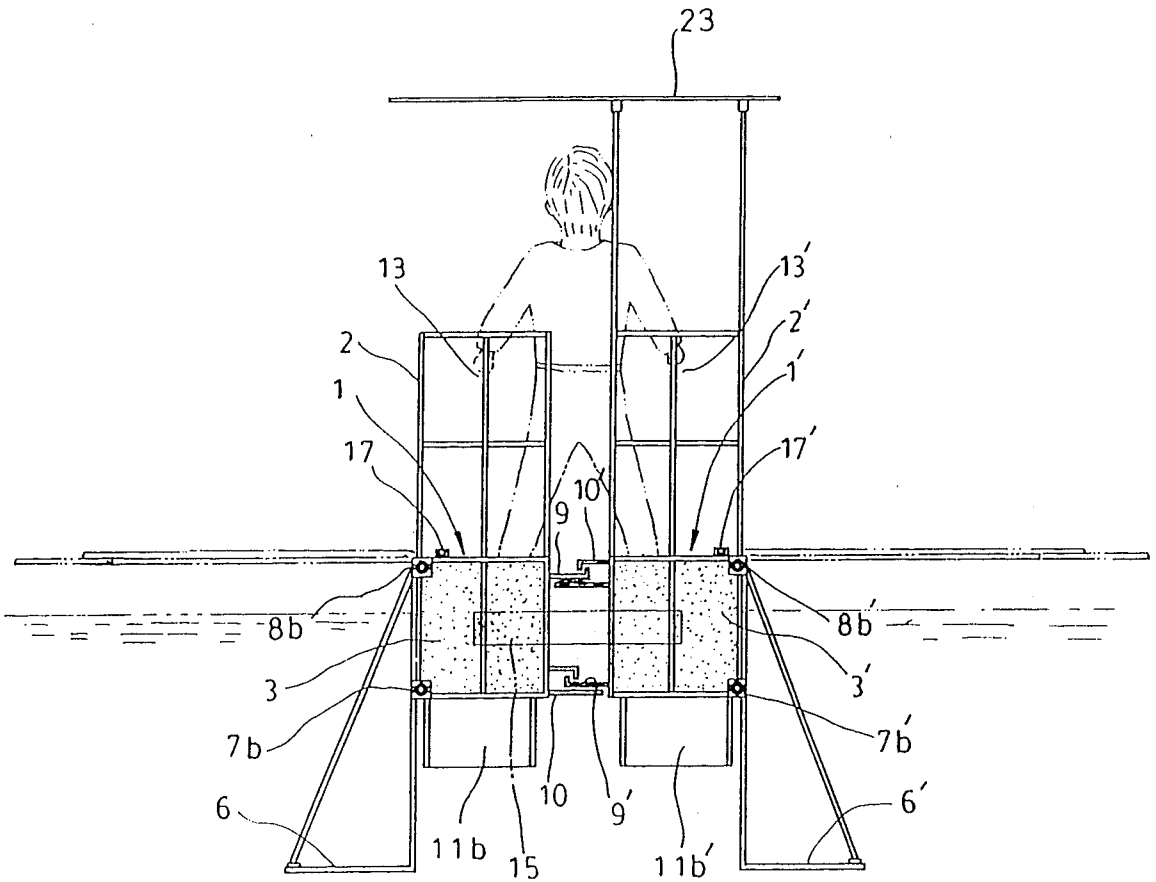
FIG. 3 is a rear view of the FIG. 1 apparatus.

As seen in FIG. 4, each pontoon comprises a framework that defines ten rectangular cavities. A buoyant block 3 or 3' fits into each cavity. FIG. 7 shows retainer plates screw-connected to upper surfaces of the framework to retain the buoyant blocks against upward displacement out of the respective cavities. Two of the buoyant blocks have sockets 4 or 4' in their upper surfaces to receive the persons feet. FIG. 3 shows the person standing upright with his feet in the socket structures.

Returning to FIG. 4, there is shown a slidable coupler means between the two pontoons, said coupler means comprising interlocking wall structures 9, 9', 10, 10' extending along the facing side surfaces of the respective pontoons. FIG. 3 shows how the interlocking wall structures slidably interlock to prevent the pontoons from separating laterally while permitting the pontoons to slide relative to one another (in and out of the plane of the paper in FIG. 3).

Figure 2:
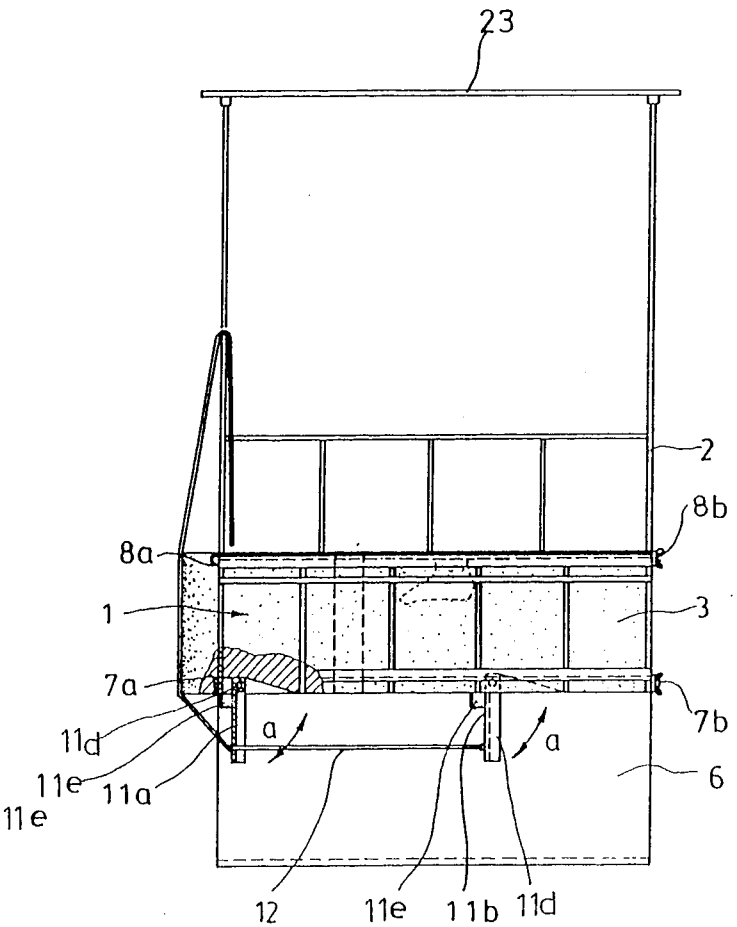
FIG. 2 is a side elevational view of the FIG. 1 apparatus.

Each pontoon has two paddles swingably attached to its undersurface to facilitate propulsion through the water. FIG. 2 shows a front paddle 11a swingably attached to the pontoon at its upper edge for movement between an extended vertical position (as shown) and a retracted horizontal position (not shown) lying against the pontoon undersurface; letter a references the swinging motion. Another rear paddle lid is similarly mounted for swinging movement. A flexible cable (cord) 12 interconnects the two paddles, whereby the two paddles move in unison between their extended and retracted positions. A forward-pulling motion on cable 12 moves the cables to their extended positions. Water pressure returns the cables to their retracted positions (when the pull force on cable 12 is withdrawn).

The other pontoon has a similar paddle-cable system similar to that shown in FIG. 2. FIG. 3 is a rear view of the paddles (**11*b*, 11*b'***) showing how they depend from the two pontoons.

Each cable (12 or 12') extends upwardly from its attachment point on the front paddle through a vertical guide tube at the front end of the associated pontoon; FIGS. 4 through 7 illustrate the guide tube. As seen in FIG. 4, each cable 12 or 12' extends upwardly from the guide tube around a pulley structure to an anchorage on a swingable control stick are mounted at an elevated position on a vertical support structure 2 that extends upwardly from the associated pontoon.

The person using the apparatus stands on the pontoons (as in FIG. 3) with his hands gripping the control sticks 13 and 13' (FIG. 13). By pulling back on one control stick the person is able to move the associated paddles (**11*a* and 11*d* in FIG. 2**) to the extended positions. When manual pressure is relaxed on the control stick the associated paddles are moved by water pressure forces to their retracted positions.

To propel the pontoon assembly in a forward direction the person holds the left control stick 13 in an upright position and the right controlstick in a pulled-back prone position. At the same time he shifts his right foot forward, The extended paddles on the left pontoon hold that pontoon in a stationary position while the right pontoon is being shifted forward. At conclusion of the forward stroke of the right pontoon the control stick positions are reversed, i.e., the left control stick is pulled back and the right control stick is pushed to an upright position. The person's left foot is shifted forwardly while the right foot exerts an anchoring force on the water through the associated paddles on the right pontoon. The operations are repeated in a motion sequence generally similar to that employed in cross country skiing.

The pontoon assembly can be turned right or left by holding one pontoon motionless while exerting successive propulsion forces on the other pontoon.

ANCILLARY FEATURES

Figure 1:
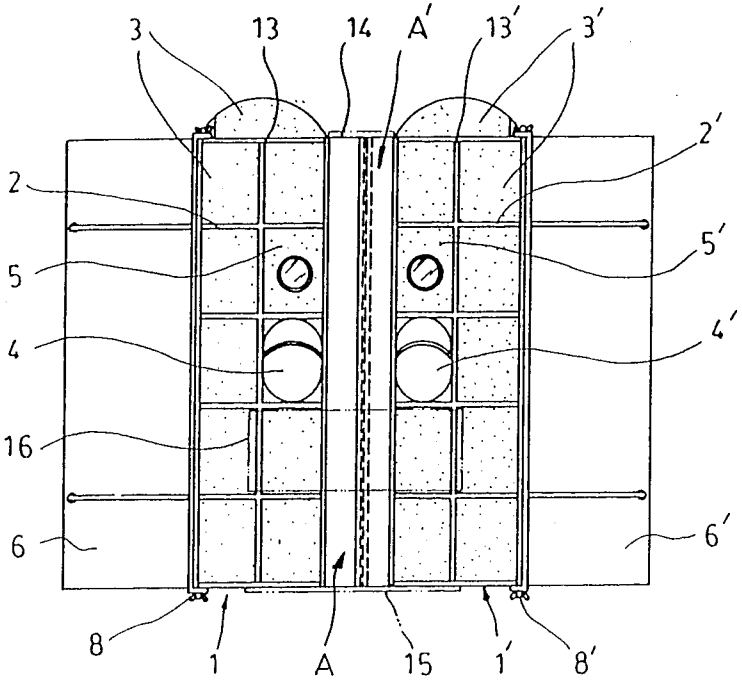
FIG. 1 is a top plan view of an apparatus embodying the invention.

The usefulness of the apparatus may be enhanced by certain auxiliary features incorporated into the apparatus. FIG. 1 shows two optical magnifiers 5 and 5' built into certain ones of the buoyant blocks forwardsly from foot sockets 4, 4'. The person can look downwardly through the magnifiers to view the underwater scenery while he is moving over the water surface.

FIG. 3 illustrates two control boards 6, 6' extending laterally outboard from the pontoons. These control boards increase the lateral stability of the pontoon assembly by acting as anti-roll devices. The control boards can be unfolded or repositioned outwardly, as shown in dashed lines (FIG. 3), to act as outriggers.

FIG. 5 illustrates an add-on sail mechanism for converting the pontoon structure into a small sailboat. The sail mechanism comprises an upright mast 18 attachable to the coupling structure (9, 10), and a canvas sail 23 attachable to the mast via collars 21 and 21' on transverse rods (booms) 29. When the pontoon structure is used as a sailboat the pontoons are immobilized against relative sliding motion by two connecting boards (plates) 14 and 15 suitably affixed by screws to the ends of coupling structure 9, 10. FIG. 1 shows the positions of the two boards 14 and 15.

FIG. 6 shows sail mechanism 23 repositioned to act as an overhead sunshade. Tube-type extension elements 24 are extended upwardly from support structures 2 to support the sunshade mechanism.

I claim:

1. Manual propulsion mechanism usable on water, comprising two elongated parallel buoyant pontoons defining a movement directional axis therebetween;

coupler means slidably interconnecting the buoyant shoes, whereby said shoes are confined to movement parallel to the directional axis;

a foot-receiving socket structure (4) in an upper surface of each buoyant pontoon;

a front propulsion paddle swingably attached to the underface of each buoyant pontoon for swinging movement in a vertical plane between an extended vertical position normal to the pontoon underface and a retracted horizontal position lying against the pontoon underface;

a rear propulsion paddle swingably attached to the underface of each buoyant pontoon for swinging movement in a vertical plane between an extended vertical position normal to the pontoon underface and a retracted horizontal position lying against the pontoon underface;

means linking each front paddle to the associated rear paddle whereby the associated paddles move in unison between the extended position and the retracted position; a vertical support structure extending upwardly from each buoyant pontoon at its front end;

pulley means mounted at an elevated point on each support structure;

a swingable hand-operated control stick mounted on each support structure in near adjacency to the associated pulley means;

and a force-transmission cable extending from each front paddle upwardly around the associated pulley means and thence to the associated control stick, whereby a manual pull-back motion on each control stick moves the associated paddles to their extended vertical positions.

2. The propulsion mechanism of claim 1, wherein each paddle has a swing axis extending transverse to the movement directional axis.

3. The propulsion mechanism of claim 1 wherein each control stick is swingable between an upright position and a prone position.

4. The propulsion mechanism of claim 1 wherein each control stick is swingably attached to the associated vertical support structure at a point substantially directly below the associated pulley means.

5. The propulsion mechanism of claim 1 wherein each front paddle is swingably attached to the associated pontoon at a point in near proximity to the leading edge of the pontoon.

6. The propulsion mechanism of claim 5 wherein each rear paddle is swingably attached to the associated pontoon at a point that is slightly behind the midpoint of the pontoon, measured in a front-to-rear direction.

* * * * *